US005299751A

United States Patent [19]

Pichlmair et al.

[11] Patent Number: 5,299,751

[45] Date of Patent: Apr. 5, 1994

[54] CLAMPING MANDREL-ENGAGEMENT SENSOR COMBINATION, PARTICULARLY FOR CLAMPING PRINTING SUBSTRATE WEB ROLLS IN A ROLL CHANGER

[75] Inventors: Gerhard Pichlmair, Neusäss; Josef Hammer, Augsburg, both of Fed. Rep. of Germany

[73] Assignee: MAN Roland Druckmaschinen AG, Offenbach am Main, Fed. Rep. of Germany

[21] Appl. No.: 959,977

[22] Filed: Oct. 13, 1992

[30] Foreign Application Priority Data

Nov. 14, 1991 [DE] Fed. Rep. of Germany ..... 4137484

[51] Int. Cl.[5] ..... B65H 18/04; B65H 63/00

[52] U.S. Cl. ..... 242/57; 242/68.4

[58] Field of Search ..... 242/57, 68.4, 68.3, 242/68.1, 68.2, 72 R, 72 B, 72.1, 129.51, 129.53; 279/126; 269/48.1, 329

[56] References Cited

U.S. PATENT DOCUMENTS

| | | | |
|---|---|---|---|
| 4,358,066 | 11/1982 | Deutschle et al. | 242/68.4 |
| 4,734,549 | 3/1988 | Naoi et al. | 200/61.41 |
| 4,735,374 | 4/1988 | Domel | 242/68.3 |
| 4,867,389 | 9/1989 | Scheuter | 242/57 X |
| 5,123,604 | 6/1992 | Hammer et al. | 242/68.4 |
| 5,192,033 | 3/1993 | Pipes | 242/57 X |

FOREIGN PATENT DOCUMENTS

| | | |
|---|---|---|
| 0067481 | 12/1982 | European Pat. Off. . |
| 0115281 | 8/1984 | European Pat. Off. . |
| 3103724A1 | 1/1982 | Fed. Rep. of Germany . |
| 3730767 | 12/1988 | Fed. Rep. of Germany . |
| 2639469 | 5/1990 | France . |

OTHER PUBLICATIONS

A. L. Riche, "Your Next Switch Selection Problem", pp. 1-6, Micro Switch Engineering, undated.

*Primary Examiner*—John M. Jillions

*Attorney, Agent, or Firm*—Frishauf, Holtz, Goodman & Woodward

[57] ABSTRACT

To sense misalignment between a clamping mandrel (1, 2) of a web roll carrier and a web center sleeve or tube (5) into which the mandrel is to be inserted, the mandrel is formed with a sensing head (8, 10, 11, 14) which is spring-loaded and projects by a distance (a) beyond an end face (9) of the tip portion (3) of the mandrel. Upon engagement of the sensing head, for example due to misalignment, with the sleeve or end face of the roll, the sensing head can resiliently slide into the mandrel and, at the same time, by coupling to an electrical switch pin (19), cause engagement of the switch pin with terminal rings (18, 19) located in the mandrel body, to cause reversal of movement of the mandrel from a forward or inserting movement (F) to reverse or retract (R) the mandrel, thus effectively and simply eliminating damage to the sleeve or tube and/or the roll of web material, and/or the mandrel.

8 Claims, 1 Drawing Sheet

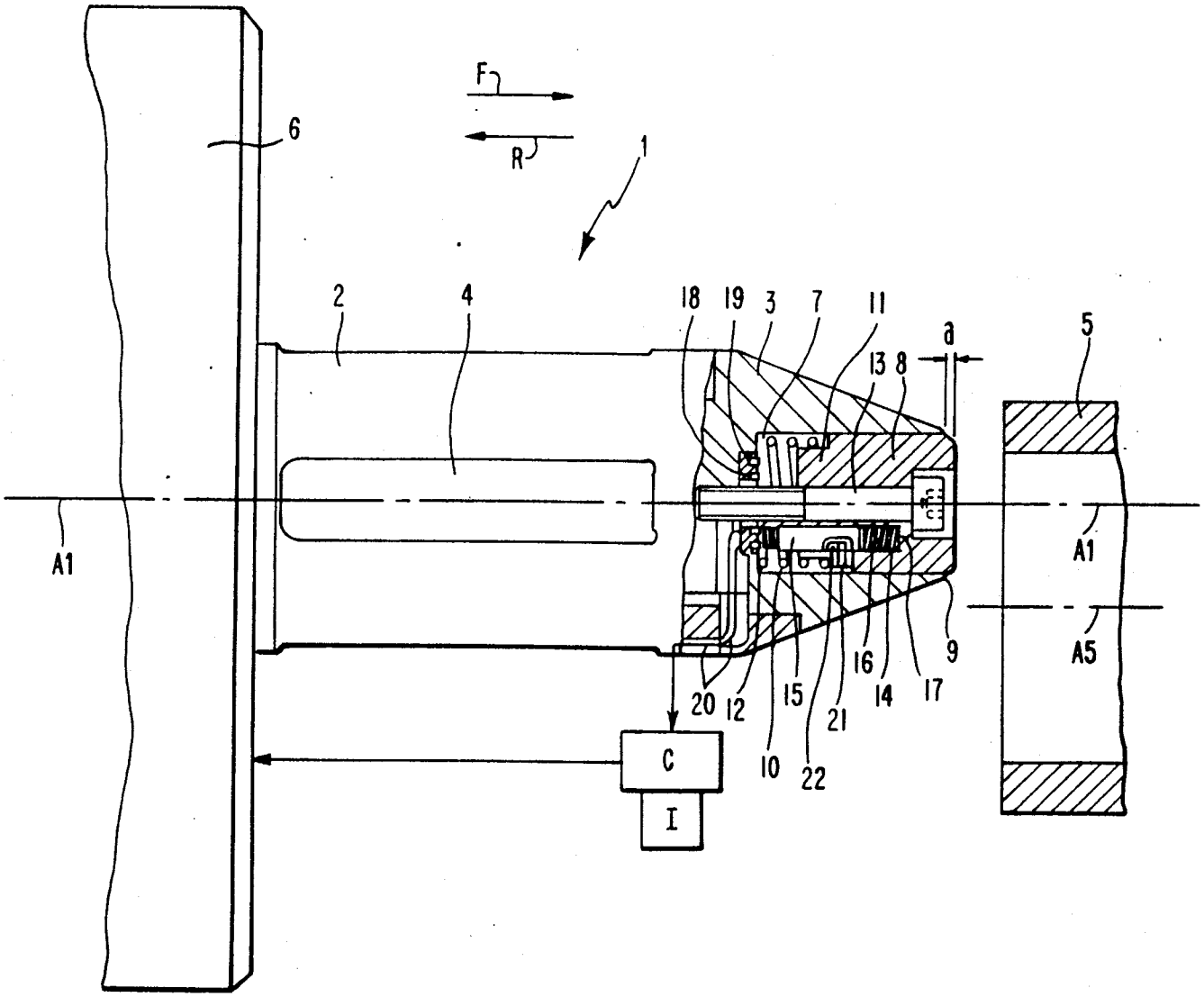
1
2
3
4
5
6
7
8
9
10
11
12
13
14
15
16
17
18
19
20
21
22
a
A1
A5
F
R
C
I

CLAMPING MANDREL-ENGAGEMENT SENSOR COMBINATION, PARTICULARLY FOR CLAMPING PRINTING SUBSTRATE WEB ROLLS IN A ROLL CHANGER

REFERENCE TO RELATED PUBLICATION

U.S. Pat. No. 5,123,604, Hammer et al, assigned to the assignee of the present application, to which German 40 13 092 corresponds.

FIELD OF THE INVENTION

The present invention relates to a clamping mandrel and sensor combination to determine if a clamping mandrel can be axially shifted into an inner sleeve of web material, for example printing substrate web, and especially newsprint, which is to be placed on a support arm of a roll carrier structure.

BACKGROUND

Clamping mandrels are usually used to clamp rolls of printing substrate webs, for example newsprint, by axially shifting two mandrels from opposed sides into support sleeves of the respective roll. The end portions of these mandrels taper towards a usually blunt tip to facilitate insertion.

Clamping mandrels of the type to which the present invention relates are well known, and one such mandrel is described, for example, in U.S. Pat. No. 5,123,604 Hammer et al. The side walls of the roll changers have carrier arms, rotatable about an axis. The carrier arms are spaced apart or can be shifted to accept the width of the roll of substrate web to be accomodated, and the holding mandrels are then shifted axially to fit into the inner roll-up sleeves of the respective substrate web rolls. The mandrels at the opposite sides of the roll can be identical. A roll of web material can then be clamped between such essentially identical mandrels. The mandrels, or at least one of them, are coupled to a drive system, usually located at the respective end of the carrier arms. The drive system permits rotation of the mandrels about their axes, as well as axial movement of the mandrels when a new roll is to be inserted, or an old roll, or the sleeve of an old roll is to be removed.

Substrate webs, and particularly newsprint rolls, are heavy, weighing several tons. These rolls are usually supplied to the roll changers by an automatic transport system, or delivered from trucks. A lifting hoist, which may already be installed on a truck, raises the rolls to a position where the mandrels can be inserted into the central sleeves at a loading position. This raising is difficult since the very heavy rolls must be aligned approximately axially with respect to the clamping mandrels. Any positioning errors, or positioning tolerances, as well as deviations of the geometrical configuration of the web roll from an ideal or standard size may result in misalignment between the roll and the clamping mandrel. Further, the cross section of the central sleeve about which the substrate web is wound may not be entirely precisely circular, or the sleeve may be somewhat eccentric with respect to the substrate web wound thereon. If the transport and raising system is automatically operated, deviations of the loading position from the axial alignment of the clamping mandrel are practically unavoidable.

Usually, the clamping mandrels have tapered ends, which are somewhat blunt, in order to minimize danger of damage to the sleeve, and facilitate insertion of the mandrel even though there may be misalignment upon placement of the roll in the roll changer apparatus, and prior to insertion of the clamping mandrels.

If the positioning error between the substrate web roll and the clamping mandrel is high, and, particularly if the loading system is controlled by an automatic sequencing apparatus, the situation may arise that the end portions of the clamping mandrel engage against the end surfaces of the sleeve and, upon a serious error, even against the end surfaces of the substrate material wound in a roll. If the end portion of the clamping mandrel engages the sleeve, damage to the sleeve may result since the clamping mandrels are pressed into the sleeve with substantial force. This damage may be severe enough to inhibit reception of the roll on the carrier arms; upon excessive misalignment, damage to the web may be severe enough to prevent use of the web in a web printing machine, since uniform pull-off and unrolling of the substrate web from the roll can no longer be ensured.

It has been proposed to provide a light gate to measure the position of the roll, and its sleeve, prior to engagement of the mandrel with the sleeve. This, however, is an indirect way of measuring, requires an additional measuring apparatus and a measuring position, and an additional measuring location coupled to the control for the automatic transport system or to the lifting arrangement, which lifting arrangement must position the roll. An additional measuring system, further, may introduce additional errors due to the additional measuring itself. Experiments have shown that light gates to measure the relative position of the sleeve and the mandrel and determine alignment of the sleeve with respect to the mandrel are not accurate enough since the light beam which is usually used cannot be focussed accurately enough if rolls of widely different varying standard diameters and widths have to be accepted by the roll changer. This is particularly annoying when the widths of the rolls are subject to wide variations.

THE INVENTION

It is an object to provide a clamping mandrel system which, simply and inexpensively, permits recognition of misalignment between a clamping mandrel and a roll to be located on the mandrel, typically a printing substrate web roll, and which easily and without damage recognizes conditions in which acceptance of the roll on the mandrel, without damage to either the roll sleeve or the mandrel, is not possible; which further prevents damage of the substrate web wound on the roll itself upon excessive misalignment, and which, additionally, provides an output signal, so that operators of the printing machine can take corrective action, where necessary and to the extent necessary.

Briefly, the mandrel has a sensing head located at the tip portion thereof, and sensing the relative radial position of the mandrel with respect to the carrier sleeve to determine if the axial alignment of the mandrel and the carrier sleeve will permit insertion of the mandrel into the carrier sleeve without damage thereto. This sensing head includes an electrical switch, which may, for example, be mechanically operated upon engagement with the carrier sleeve and/or the end face or surface of the web when wound on a roll, the switch being integrated into the sensing head and signaling a change-of-state, that is, between open and closed state of the switch, if an obstruction - for example the carrier sleeve or the end face of the roll, is encountered. The switch is coupled to the usually present control console or control unit for the printing machine and/or the loading and roll changer unit thereof. The control console is responsive to sense the change-of-state of the switch and controls axial movement of the mandrel body to reverse the direction of axial insertion movement of the mandrel body, so that damage to the sleeve and/or the end face of the substrate web roll is effectively avoided. In addition, an output signal showing that such reverse movement was commanded can be given, for example to an operator, by the control console.

Use of a mechanically operated sensing element, in which an electric switch is integrated, has the advantage of ultimate simplicity and reliability. It is, further, readily possible to recognize misalignment, independently of the force of insertion movement of the mandrel into the sleeve, and rapidly command discontinuance of insertion movement and, preferably, immediate reversal of the insertion movement of the clamping mandrel, for example for a predetermined limited distance, thereby effectively preventing damage to the sleeve, and the subtrate roll thereon, as well as to the mandrel, and the insertion apparatus.

DRAWINGS

The single FIGURE is a highly schematic side view, partly in section, of an insertion system including an insertion mandrel, to be inserted into a support sleeve for a substrate web roll.

DETAILED DESCRIPTION

The single FIGURE is a highly schematic side view of a mandrel, as well known, in combination with the present invention. Mandrel 1 has a cylindrical mandrel body 2 and a frusto-conical tip or end portion 3. The body 2 is formed with a plurality of spreader elements 4, in accordance with any well known construction, for clamping engagement within a center sleeve or center tube 5 of a roll of printing substrate, for example a roll of paper on which printing is to be effected. The roll itself as well as the end face thereof are not shown, for simplicity of the drawing. The end face of the roll of paper can be flush with the end face of the inner sleeve or wind-up tube 5. The entire mandrel 1 can be moved in axial direction, for example by a stripper ring 6, which can also form an insertion limiting element. The stripper ring 6, likewise, is well known and does not form part of the present invention. The insertion direction is schematically shown by the forward movement arrow F, and withdrawal or reverse or retraction direction by the reverse arrow R. The mandrel has a central axis A1.

The forward or tip portion 3, typically blunt, is shown in fragmentary sectional representation. It is formed with a concentric recess 7 in which a sensing head is slidably located. The sensing head includes a bolt 8 which extends by a small distance a beyond the end surface 9 of the tip portion 3 of the mandrel. The bolt 8 is resiliently retained within the concentric recess 7 by a compression spring 10 which is spiralled about an inturned inner end portion 11 of the bolt 8. The spring 10 engages the bottom 12 of the recess 7 to permit resilient axial movement of the bolt 8 in the recess 7. The bolt 8 is retained in the recess 7 by a screw bolt 13, passing through a central opening in the bolt 8 and screwed into a tapped inner hole extending axially inwardly from the recess 7 into the body 2 of the mandrel, so that the bolt 8 will be resiliently biassed, in an outward direction, by the spring 10. By screwing the headed bolt 13 into and out of its tapped opening, the dimension a by which the bolt 8 projects from the facing surface 9 of the tip portion 3 of the mandrel 2 can be adjusted. Preferably, and not shown since well known, the bolt 8 can be screwed against an adjustable stop, so that the dimension a can be easily set and reproducibly obtained.

The bolt 8 is coupled to a switch, in form of an eccentrically positioned, for example cylindrical recess 14, within which a switch operating pin 15 is slidably retained. The pin 15 is resiliently held in the recess 14 by a holding spring 16, engaging the bottom 17 of the recess 14. The switch pin 15 can bridge open exposed contacts 18, 19 of an electrical circuit 20. The electrical terminals 18, 19 are formed by two ring-shaped concentrically located terminal rings or strips, located in the bottom 12 of the recess 7, and insulated from each other. The switch pin 15 has a limited travel, which is determined by a notch 22 longitudinally formed in the pin 15, which notch 22 is engaged by a radial pin 21, fitted into the notch 22 and retained, for example, in a small recess or radial depression or radial hole formed in the bolt 8. Thus, the pin 15 is held in Position and prevented from falling out by the radial pin 21, which, also, limits the movement of the pin 15.

The switch changes state between the illustrated position, which is normally open, by bridging across the contacts 18, 19.

The circuit 20 is coupled to a control unit C, which also controls insertion or forward and retraction movement, see arrows F and R of the mandrel body 2, by controlling a suitable drive arrangement therefor. This drive arrangement operates in conjunction with a signaling circuit or an indicator, schematically shown at I, so that if initially a forward movement R is commanded and, upon sensing an obstruction, the mandrel 1 is to be retracted, a positioning error signal will be indicated.

In accordance with a preferred feature of the invention, the forward portion 3 of the mandrel 2, and especially the edge surface 9 as well as the end surface of the bolt 8, are so constructed that all engaging outwardly appearing surfaces are smooth, without any edges.

Operation

The threaded bolt 13 is so adjusted that the maximum distance by which the switch pin 15 from the contact rings 18, 19 is smaller than the distance a.

The single figure illustrates the clamping mandrel 1 in retracted position, opposite a web roll having the roll tube or sleeve 5 which, however, is off-center with respect to the mandrel. The center line or axis of the sleeve 5 is shown at A5. If, then, the mandrel 1 were to be moved in the forward direction, the end portion would impinge against the facing surface of the sleeve 5. This, however, in accordance with the present invention, will not lead to damage since the bolt 8 is compressed against the force of the spring 12, and carries along the switch pin 15, which then will engage and connect across the contact rings 18, 19. The circuit 20 has changed state from open circuit to closed circuit. This change of state is sensed in the control unit C which reverses the axial movement of the mandrel 1 in the direction of retraction, see arrow R, while, simultaneously, providing a "misalignment" output indication at the indicator I, so that an operator is notified of the misalignment in order to take corrective action and arrange for alignment of the sleeve 5 with the mandrel 1, so that the axes Al and A5 will be at least approximately closely congruent. Damage to the sleeve 5 is thereby reliably excluded.

The spring-loaded arrangement of the bolt 8 by spring 12 and the spring-loaded arrangement of the contact pin 15 and spring 16 ensure that the sleeve 5 is initially engaged against an obstruction only with a small force. The minimum spacing of the switch pin 5 from the contacts 18, 19 is smaller than the spacing a. The required braking distance, to stop forward movement of the mandrel 1, less dimension a determines the maximum spacing of the switch pin 15 from the contacts 18, 19 in order to overcome the time delay between engagement of the bolt 8 with an obstruction and reversal of movement from forward, see arrow F, to retraction or reverse, see arrow R.

The forward end portion 3 of the mandrel 2 is constructed in conical form, so that, if there is only slight misalignment, the sleeve 5 and the mandrel 1 can move relative to each other comparatively easily, in a sliding movement, without damaging the mandrel 1, even if there is a deviation between the congruent positions of the axes A1 and A5. This deviation may be within a tolerance region in which the entire cross section of the sensing head bolt 8 is receivable directly within the opening formed by the sleeve 5; this tolerance, at the most, is equivalent to the radius of the cylindrical bolt 8; of course, it may be less.

Various changes and modifications may be made within the scope of the inventive concept.

We claim:

1. Clamping mandrel-engagement sensor combination for clamping a roll of web material, particularly a printing substrate web roll, and especially newsprint, rolled on a carrier sleeve or tube (5) having an axially slidable mandrel body (1, 2), having a conically tapering tip portion (3);

clamping means (4) on the mandrel body, fitting into the carrier sleeve or tube (5) and being radially expandible for engagement with the carrier sleeve; and control means (C, 6) controlling axial advance or forward movement (F) and axial retraction or reverse movement (R) of the mandrel body with respect to the sleeve or tube (5), comprising, in accordance with the invention, a sensing head (8, 10, 11, 14) located at said tip portion (3) of the mandrel (1, 2) and sensing the relative radial position of the mandrel with respect to the carrier sleeve or tube to determine if the axial alignment of the mandrel and of the carrier sleeve or tube permits insertion of the mandrel into the carrier sleeve or tube without damage thereto, said sensing head including an electrical switch (15, 16, 18, 19) integrated therewith, and a change-of-state of the switch between an open and closed state upon sensing an obstruction at said tip portion due to axial misalignment of said mandrel body (1, 2) and said sleeve or tube (5), said switch being coupled to said control means; and the control means being responsive to sensing said change-of-state and controlling axial movement of the mandrel body for reverse or retracting movement (R) of the mandrel and providing an output signal (I) representative of misalignment between the mandrel and the sleeve or tube.

2. The combination of claim 1, wherein said sensing head (8, 10, 11, 14) comprises a cylindrical bolt element (8);

wherein the tip portion (3) of the mandrel body is formed with a recess (7) concentric with an axis (A1) of the mandrel, said bolt element (8) being slidably received within said recess (7);

spring means (10) are provided, resiliently supporting the bolt element (8) for axial sliding movement within said recess (7); and bolt element positioning means (13) are provided, coupled to said bolt element (8) and to said mandrel body (1, 2) and controlling the position of said bolt element (8) for projection beyond an end surface (9) of the tip portion (3) of the mandrel body by a predetermined distance (a).

3. The combination of claim 2, wherein said spring means are engaged against the bottom of the recess (7);

said bolt element being formed with a reduced inner end portion (11) and said spring means surrounding said reduced inner end portion.

4. The combination of claim 2, wherein the bolt element positioning means comprises a screw bolt (13) passing axially through an opening within the bolt element (8) and screwed into the mandrel body (1, 2), thereby positioning the bolt element within the mandrel body and determining the distance (a) of projection of the bolt element from the end surface (9) of the tip portion (3) of the mandrel body (1, 2).

5. The combination of claim 2, wherein the electrical switch comprises a switch pin (15) located in a longitudinal recess (14) within the bolt element (8);

switch terminals (18, 19) located within the mandrel body (1, 2) insulated from each other, and positioned for engagement by said switch pin (15);

switch spring means (16) coupled to the switch pin (15) and resiliently spacing the switch pin from the bottom (17) of the recess (14); and switch pin movement control means (21, 22) limiting movement of the switch pin away from the bottom of the recess (7) and preventing accidental escape of the switch pin (15) from the axial opening (14).

6. The combination of claim 5, wherein the electrical terminals (18, 19) of the switch comprise two concentric terminal rings located at the bottom (12) of the recess (7);

and switch circuit connection means (20) coupling the terminal ends to the control means (C).

7. The combination of claim 1, wherein the tip portion (3) of the mandrel body and the sensing head define smoothly merging surfaces devoid of edges.

8. The combination of claim 2, wherein said projecting distance (a) is determined by at least the operating distance, in axial direction, of said electrical switch upon engagement of the sensing head with an obstruction plus the braking distance required to stop advance or forward movement (F) of the mandrel body, and reverse the movement of the mandrel body in a reverse or retracting direction (R).

* * * * *